United States Patent [19]

Melikian

[11] 4,269,525

[45] May 26, 1981

[54] WRITING INSTRUMENT WITH RETRACTABLE TIP

[76] Inventor: Robert B. Melikian, 235 E. 51st St., New York, N.Y. 10022

[21] Appl. No.: 51,565

[22] Filed: Jun. 25, 1979

Related U.S. Application Data

[63] Continuation of Ser. No. 869,723, Jan. 16, 1978, abandoned.

[51] Int. Cl.[3] ..... B43K 24/00

[52] U.S. Cl. ..... 401/108

[58] Field of Search ..... 401/107, 108

[56] References Cited

U.S. PATENT DOCUMENTS

| | | | |
|---|---|---|---|
| 2,405,958 | 8/1946 | Kelley | 401/107 |
| 2,559,906 | 7/1951 | Tursky | 401/108 |
| 2,952,242 | 9/1960 | Rosso | 401/108 |
| 3,203,403 | 8/1965 | Yanagita | 401/108 |
| 3,362,778 | 1/1968 | Pavese | 401/107 |
| 3,399,946 | 9/1968 | Tokorozawa et al. | 401/108 |
| 3,525,573 | 8/1970 | Fend | 401/108 |
| 3,594,091 | 7/1971 | Bleuer | 401/107 |
| 3,637,316 | 1/1972 | Bross | 401/107 |
| 3,945,734 | 3/1976 | Woodbridge | 401/108 |

FOREIGN PATENT DOCUMENTS

| | | | |
|---|---|---|---|
| 93045 | 3/1962 | Denmark | 401/108 |
| 1229879 | 12/1966 | Fed. Rep. of Germany | 401/107 |
| 469200 | 2/1952 | Italy | 401/108 |
| 1249550 | 10/1971 | United Kingdom | 401/108 |
| 1400781 | 7/1975 | United Kingdom | 401/108 |

*Primary Examiner*—William Pieprz

*Attorney, Agent, or Firm*—Arthur A. March

[57] ABSTRACT

A flexible shield comprising a piece of flexible material shaped to fit into and be attached to the interior of the barrel of a retractable tip pen in proximity to the tip and having a central aperture which may comprise cross slits whose edges are adapted to move away from each other to expand the aperture when the tip is emitting from the barrel and to return to normal substantially closed position over the tip when the tip is retracted into the barrel to perform the dual function of inhibiting the passage of air to dry out the tip and to wipe the tip free of accumulated liquid build-up or dust.

5 Claims, 4 Drawing Figures

WRITING INSTRUMENT WITH RETRACTABLE TIP

This is a continuation of copending parent application Ser. No. 869,723, filed Jan. 16, 1978, now abandoned.

BACKGROUND OF THE INVENTION

Heretofore there has been increasingly extensive use of what are commonly called "felt tip" pens or writing instruments. Such pens have a reservoir of fluid with which to provide the written impression. A cover is usually provided for these pens to prevent the felt tip itself from constant exposure while being carried in the pocket of the user, or in a handbag, etc., in which latter event soiling and damage might occur in the absence of such a cover. Furthermore, such covers for the exposed ends of the felt tip instruments are often lost with the aforedescribed possibility of damage to the exposed tip and the drying out of the tip. In fact, drying out of the tip from the evaporation of the ink has been and continues to be a problem.

The dimensions of the problem concerning the aforesaid drying out of the tip are demonstrated by the fact that such felt tip pens are not provided with means for retracting and emitting the tip from the barrel as is the case with conventional ballpoint pens and the like. One of the reasons for the lack of retraction means in felt tip pens is the possibility that atmospheric conditions passing around the tip will cause premature evaporation of the liquid thereon.

In addition, in connection with other types of retractable pens, problems have arisen as a result of the accumulation of liquid around the tip which may require wiping from time to time and the adherence of dust and other particles to the tip which interfere with normal writing.

SUMMARY OF THE INVENTION

The present invention solves the aforesaid problems by means of structure which permits the retraction into the barrel of the tip of the writing instrument but nonetheless has inhibiting means against the drying out of the tip or evaporation of the liquid with which the tip is impregnated. These same means also perform the function of wiping excess liquid and dust from the tip of the pen. This is accomplished by the provision of a flexible apertured shield disposed within the barrel near the end of the casing from which the felt tip is extended for writing purposes and withdrawn when not in use. This shield which may be of rubber or any suitable flexible material, such as plastic, is secured around the interior perimeter of the barrel at the point of egress and ingress of the felt tip. A central aperture is provided whereby the tip itself as it is extended outwardly for writing purposes, causes the shield to yield around the aperture. The tip then passes through the enlarged aperture. When the tip is being retracted, the flexibility of the shield prevents it from interfering with the retraction movement and as the tip is withdrawn, the aperture gradually closes. When the tip is fully retracted the shield closes around the top point of the tip leaving little, if any aperture exposure.

DETAILED DESCRIPTION OF THE INVENTION

Figure 1:
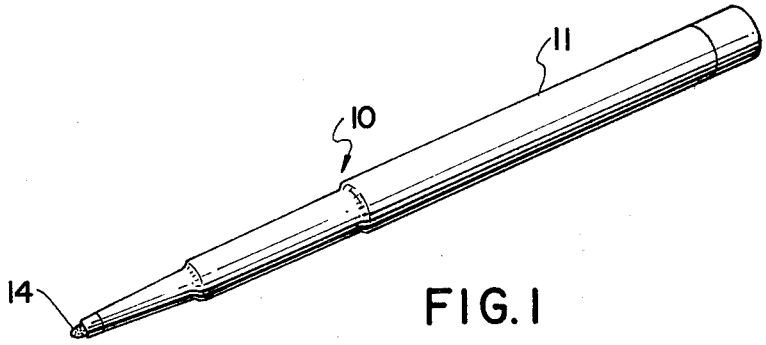
FIG. 1 is a perspective view of the tip of the writing instrument showing the shield of the present invention.
Figure 2:
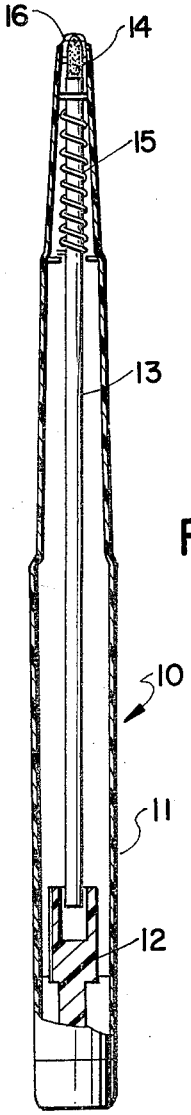
FIG. 2 is a sectional view of the writing instrument shown in FIG. 1.

As specifically shown in the drawings, the present invention involves a writing instrument generally designated as 10 which comprises a barrel portion 11. One end of the barrel has a stem portion 12 which, as shown in FIG. 2, frictionally engages one terminus of a cylinder 13, with the cylinder being movably disposed completely longitudinally within the barrel (see FIG. 2). The other terminus of the cylinder 13 may comprise a "felt tip" writing portion 14. As illustrated, a spring element 15 surrounds the cylinder 13 interiorly of the barrel 11 adjacent the felt tip portion 14 of the cylinder 13. Thus, the writing instrument embodies the conventional springloaded retractable tip structure wherein a movement of the stem 12 causes the emission from the barrel of the felt tip 14 and the next sequential movement of the stem 12 causes the retraction of the felt tip into the barrel. This conventional type writing instrument normally exposes the felt tip to atmosphere to make it susceptible to drying out through evaporation of the fluid supply, etc. To solve this problem, the present invention provides an efficient and economic shield 16 disposed as hereinafter set forth. The shield as illustrated is a flexible unitary shield or barrier which comprises a flexible disc having a small aperture 17 in the central outwardly raised transversely extending offset portion formed by slits 18. While the aperture is shown as being provided by the slit arrangement, it will be understood that any form of aperture means which will expand to some degree to permit the passage of the tip therethrough and contract when the tip is retracted may be useable for the purpose.

Figure 3:
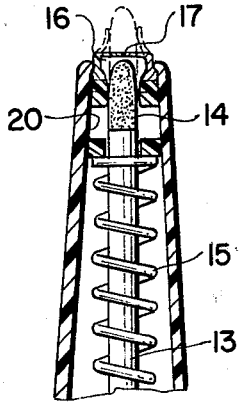
FIG. 3 is an exploded sectional view of an end portion of the tip of the writing instrument of the present invention showing in dotted lines a progressive step of the wiping action of the shield upon its emission from the barrel.
Figure 4:
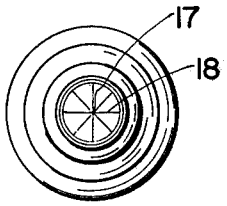
FIG. 4 is a top view of the end portion of the writing instrument of the present invention showing the shield.

The shield 16 is stationarily secured around its outer perimeter 19 to the interior of the barrel 20 by any suitable means, with such interior forming a writing end opening of fixed size and cross-section sufficient for permitting passage of the tip 14 of selective concordant perimetric size and cross-section therethrough with clearance between such tip and opening during emission and retraction of the tip (see FIG. 3). When the shield is substantially flat in the position shown in FIG. 4, it will be noted that the aperture 17 is minute in size and the edges of the slits 18 abut each other to provide a substantially closed area inhibiting the passage of air therethrough, the apertured central portion of the flexible shield 16 being externally stationarily located on the barrel 20 and extending outwardly across the writing end opening of the barrel. However, the flexible shield 16 may be flexed and bowed at its central portion, as shown in FIG. 3. This flexing moves the edges of the slits 18 away from each other to enlarge the aperture 17 and permit the passage of the felt tip 14 therethrough. The writing instrument is then in condition for use.

The passage of the tip through the edges of the slits 18 also accomplishes another and highly desirable result, i.e. that of wiping the tip, as shown in dotted lines in FIG. 3. In this fashion, liquid build-up on the tip and the accumulation of dust or other particles both of which occur in connection with the use of some pens are wiped clean.

Of course, the tip 14 is normally biased, i.e. by the spring element 15 as resilient means acting on the cylinder 13, into retracted position within the barrel 20 rearwardly spaced from the apertured portion of the flexible shield 16, yet is extensible from the barrel upon movement of the stem 12, as aforesaid.

In addition, it is within the contemplation of the present invention that the term "flexible" for the shield encompasses all degrees of flexibility including that semi-flexible construction in which the shield may be of material which inherently has "memory", i.e. the ability to return to its normal flat position upon releasing of the means which flex or deform it.

It will be understood that while one form of emitting and retracting means for the tip of the pen has been illustrated, other standard and used forms may be utilized for such emission and retraction within the scope of the invention. Thus variations and modifications may be made without departing from the spirit of the invention as defined in the appended claims.

I claim:

1. A writing instrument comprising a barrel having a writing end opening, a cylinder movably disposed completely longitudinally within the barrel and having a corresponding writing end portion, a writing tip having a fluid dispensing element carried on said end portion of the cylinder, means for projecting and retracting said writing tip through the writing end opening of the barrel, said writing tip having a predetermined perimetric size for projection through the writing end opening of said barrel, said writing end opening having a fixed size relative to the size of the writing tip sufficient for permitting passage of said tip therethrough with clearance between said tip and said writing end opening during such projection, and a cup-shaped flexible unitary shield having an open base portion stationarily disposed within and rigidly secured to said barrel in proximity to said writing end opening and having a protruding apertured portion extending externally from the base portion and extending outwardly across the writing end opening thereof to thereby close said opening, said apertured portion having an aperture defined therein, said flexible shield being movable at said apertured portion by contact with said tip upon the projection of said tip from said barrel to expand said apertured portion and remain in contact with said fluid dispensing element and forming, when closed, a barrier against the passage of air.

2. The writing instrument in claim 1 in which the aperture comprises a centrally disposed slit.

3. The writing instrument of claim 1 in which the edges of the aperture of the shield are in proximity to each other to provide a wiping action for the tip as it passes therethrough.

4. The writing instrument of claim 1 in which the apertured portion is outwardly raised from and transversely extends across the writing end opening of the barrel, and the tip is projectable from the barrel and retractable into the barrel by said means for projecting and retracting and is normally biased by resilient means into a retracted position within the barrel rearwardly spaced from the apertured portion of the flexible shield.

5. The writing instrument of claim 1 in which the tip is a felt tip on said cylinder.

* * * * *